US011403994B1

(12) United States Patent
Cheng

(10) Patent No.: US 11,403,994 B1
(45) Date of Patent: Aug. 2, 2022

(54) LIGHT EMITTING ASSEMBLY AND LIGHT EMITTING DEVICE INCLUDING THE SAME

(71) Applicants: Chin-Chih Cheng, Hsinchu County (TW); Ching-Chung Cheng, Hsinchu County (TW)

(72) Inventor: Ching-Chung Cheng, Hsinchu County (TW)

(73) Assignees: Chin-Chih Cheng, Hsinchu County (TW); Ching-Chung Cheng, Hsinchu County (TW)

( * ) Notice: Subject to any disclaimer, the term of this patent is extended or adjusted under 35 U.S.C. 154(b) by 0 days.

(21) Appl. No.: 17/215,360

(22) Filed: Mar. 29, 2021

(30) Foreign Application Priority Data

Jan. 19, 2021 (CN) ..... 202110071177.0

(51) Int. Cl.
*G09G 3/32* (2016.01)

(52) U.S. Cl.
CPC ..... *G09G 3/32* (2013.01); *G09G 2310/0286* (2013.01); *G09G 2320/064* (2013.01); *G09G 2330/021* (2013.01)

(58) Field of Classification Search
CPC ..... G09G 2320/064; G09G 2310/0286; G09G 2330/021; G09G 3/32
See application file for complete search history.

(56) References Cited

U.S. PATENT DOCUMENTS

2007/0216315 A1* 9/2007 Kawabe ..... G09G 3/3291 315/169.3
2009/0122053 A1* 5/2009 Yamamoto ..... G09G 3/3233 345/213
2012/0206499 A1* 8/2012 Cok ..... H01L 27/3255 345/690

* cited by examiner

*Primary Examiner* — Muhammad N Edun
(74) *Attorney, Agent, or Firm* — Locke Lord LLP; Tim Tingkang Xia, Esq.

(57) ABSTRACT

A light emitting assembly includes active matrix (AM) light emitting circuits and an AM driver circuit. Each AM light emitting circuit includes at least one light emitting element, at least one shift register and a current control sub-circuit. The at least one shift register is configured to generate a control signal according to the clock signal from a clock line and the data signal from an inter-array data line and the control signal from the at least one shift register. The current control sub-circuit is configured to control the brightness of the at least one light emitting element according to the base current from a current supply line and the control signal. The AM driver circuit is configured to generate the data signal according to a serial data packet, and provide the data signal, the clock signal and the base current to the AM light emitting circuits.

7 Claims, 12 Drawing Sheets

| Dout | Action |
|---|---|
| 0 | LED no action |
| 1 | LED write operation / erase operation |

| Q0 | Q1 to Qn-1 | Dout | Action |
|---|---|---|---|
| 0 | X | 0 | LED no action |
| 1 | X | 0 | LED write operation / erase operation |
| 0 | X | 1 | LED write operation / erase operation |

| Q0 | Q1 | Dout | Action |
|---|---|---|---|
| 0 | 0 | 0 | LED no action |
| 1 | 0 | 0 | LEDR write operation / erase operation |
| 0 | 1 | 0 | LEDG write operation / erase operation |
| 0 | 0 | 1 | LEDB write operation / erase operation |

| Q0 | Q1 | Q2 | Q3 to Qn-3 | Qn-2 | Qn-1 | Dout | Action |
|---|---|---|---|---|---|---|---|
| 0 | 0 | 0 | X | 0 | 0 | 0 | LED no action |
| 1 | 0 | 0 | X | 0 | 0 | 0 | LEDR write operation / erase operation |
| 0 | 1 | 0 | X | 0 | 0 | 0 | LEDG write operation / erase operation |
| 0 | 0 | 1 | X | 0 | 0 | 0 | LEDB write operation / erase operation |
| 0 | 0 | 0 | X | 1 | 0 | 0 | LEDR write operation / erase operation |
| 0 | 0 | 0 | X | 0 | 1 | 0 | LEDG write operation / erase operation |
| 0 | 0 | 0 | X | 0 | 0 | 1 | LEDB write operation / erase operation |

LIGHT EMITTING ASSEMBLY AND LIGHT EMITTING DEVICE INCLUDING THE SAME

CROSS-REFERENCE TO RELATED APPLICATIONS

This non-provisional application claims priority under 35 U.S.C. § 119(a) on Patent Application No(s). 2021100711770 filed in China on Jan. 19, 2021, the entire contents of which are hereby incorporated by reference.

BACKGROUND

1. Technical Field

The present disclosure relates to a light emitting assembly, and particularly to a light emitting assembly which has a driver circuit.

2. Related Art

As modern society is increasingly advocating for green lighting and energy saving, lighting emitting diodes are used as light emitting elements in more and more lighting products, such as display screens, backlight modules, etc. Moreover, with the prevalence of mobile devices and the development of image related technology, people's demand for the size or the resolution of devices is increasing day by day.

SUMMARY

Accordingly, this disclosure provides an active matrix type light emitting assembly and a light emitting device comprising the light emitting assembly to reduce the required installation space of the light emitting assembly, that is, to increase the number of light emitting assemblies that can be installed in a space unit.

According to one embodiment of the present disclosure, a light emitting assembly comprises a plurality of active matrix (AM) light emitting circuits and an active matrix (AM) driver circuit. The plurality of AM light emitting circuits are connected to a clock line and at least one current supply line and serially connected to each other through an inter-array data line. Each of the AM light emitting circuits comprises at least one light emitting element at least one shift register, and a current control sub-circuit. The at least one shift register is configured to generate a control signal according to a clock signal from the clock line and a data signal from the inter-array data line. The current control sub-circuit connected to the at least one shift register and the at least one light emitting element is configured to control brightness of the at least one light emitting element according to a base current from the current supply line and the control signal from the at least one shift register. The AM driver circuit connected to the plurality of AM light emitting circuits through the inter-array data line, the clock line and the at least one current supply line is configured to generate the data signal according to a serial data packet and provide the data signal, the clock signal, and the base current to the plurality of AM light emitting circuits.

According to one embodiment of the present disclosure, the light emitting device comprises the plurality of light emitting assemblies as the embodiment described above, wherein the AM driver circuits of the light emitting assemblies are serially connected to each other through the clock line and a serial data line and each of the AM driver circuits of the plurality of light emitting assemblies obtains the serial data packet from the serial data line.

With the above structure, in the AM driver circuit in the light emitting assembly disclosed in the present disclosure, the light emitting circuits are controlled by a series control method and the driver circuit may be implemented with a small number of circuits with low complexity, so the material cost and wiring cost may be low and the installation space required may be small. Through the design of a driver circuit and the light emitting circuit both disposed in the light emitting assembly, there may be no need to dispose an additional driver circuit board in the light emitting device that comprises multiple light emitting assemblies disclosed in the present disclosure, so the installation space needed for the light emitting device may be small or the number of light emitting assemblies that can be installed in a space unit may be large.

BRIEF DESCRIPTION OF THE DRAWINGS

The present disclosure will become more fully understood from the detailed description given herein below and the accompanying drawings which are given by way of illustration only and thus are not limitative of the present disclosure and wherein.

DETAILED DESCRIPTION

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawings.

Figure 1A:
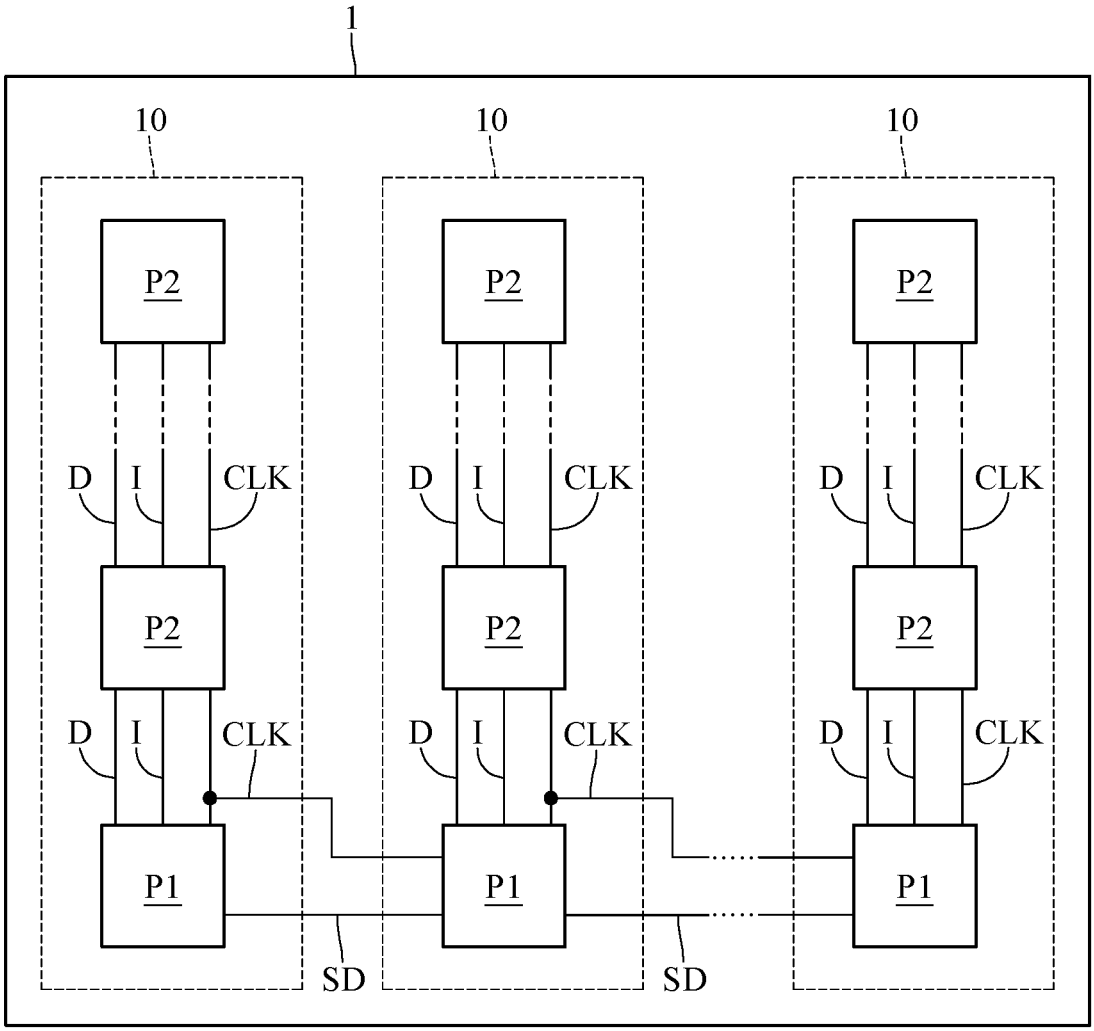
FIG. 1A is a functional block diagram of a light emitting device according to an embodiment of the present disclosure.
Figure 1B:
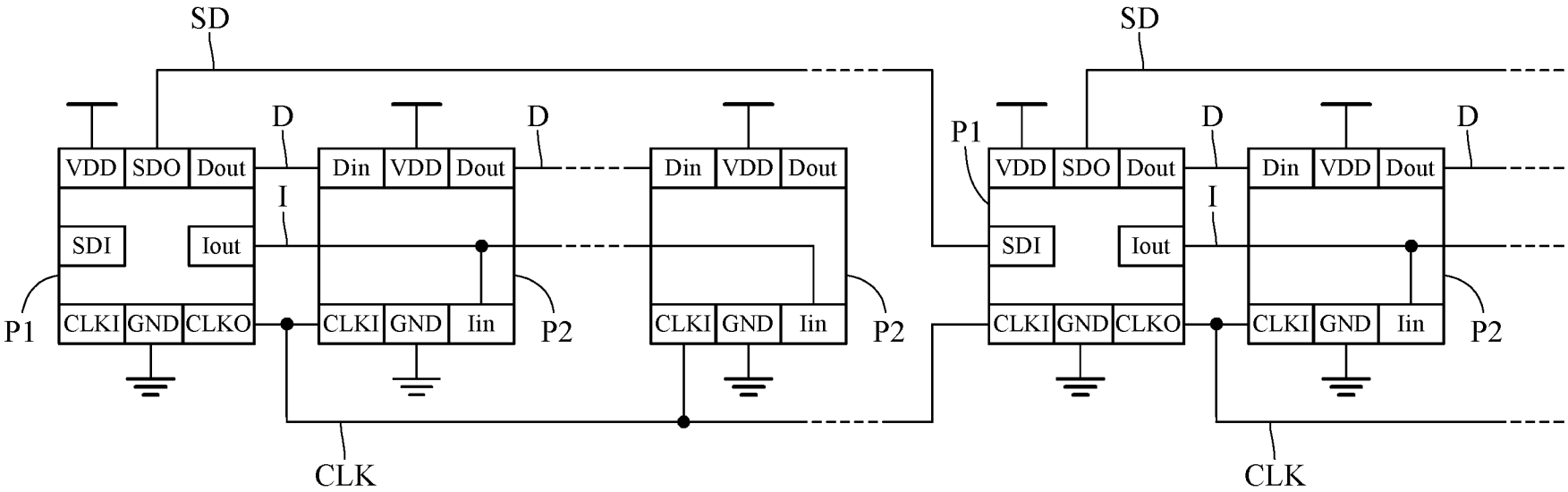
FIG. 1B is a schematic diagram of the pins of each package in a light emitting device according to an embodiment of the present disclosure.

Please refer to FIG. 1A and FIG. 1B, wherein FIG. 1A is a functional block diagram of a light emitting device according to an embodiment of the present disclosure, FIG. 1B is a schematic diagram of the pins of each package in a light emitting device 1 according to an embodiment of the present disclosure. As shown in FIG. 1A, the light emitting device 1 comprises a plurality of light emitting assemblies 10. Each light emitting assembly 10 comprises a first package P1 and one or more second packages P2. Each first package P1 in the light emitting assembly 10 can be connected to each second package P2 through an inter-array data line D, a current supply line I, and a clock line CLK. The first packages P1 in all of the light emitting assemblies 10 can be serially connected to each other through a serial data line SD and the clock line CLK. The first package P1 comprises the AM driver circuit and the AM light emitting circuit. The second package P1 comprises the AM light emitting circuit. In another embodiment, the first package P1 can only comprise the AM driver circuit.

The configuration of the pins of each package in the light emitting device 1 is further described as below. As shown in FIG. 1B, the first package P1 may have eight pins, power input pin VDD, ground pin GND, clock signal input pin CLKI, clock signal output pin CLKO, serial data input pin SDI, serial data output pin SDO, inter-array data output pin Dout, and current output pin Iout; the second package P2 may have six pins, power input pin VDD, ground pin GND, clock signal input pin CLKI, inter-array data input pin Din, inter-array data output pin Dout, and current input pin Iin.

The clock signal output pin CLKO of the first package P1 can be connected to the clock signal input pin CLKI of each second package P2 in the same stage and the clock signal input pin CLKI of the first package P1 in the next stage through the clock line CLK, and the clock line CLK includes the connection between the clock signal input pin CLKI and clock signal output pin CLKO of each first package P1. That is, each package in the light-emitting device 1 can share the same clock line CLK and operate based on the clock signal transmitted by the clock line CLK.

The serial data output pin SDO of the first package P1 can be connected to the serial data input pin SDI of the first package P1 in next stage through the serial data line SD, and the serial data line SD includes the connection between the serial data input pin SD and the serial data output pin SDO of each first package P1. That is, the AM driver circuits in the light-emitting device 1 are serially connected to each other through the serial data line SD. In terms of signal transmission operation, the AM driver circuit of the first package P1 can receive the serial data packet through the serial data input pin SDI and extract the data required for its stage from the serial data packet. Then, the AM driver circuit outputs the remaining data packet through the serial data output pin SDO and transmits it to the serial data input pin SDI of the first package P1 in the next stage through the serial data line SD. In particular, the serial data packet can comprise configuration data and grayscale data, wherein the serial data packet can have multiple tags for each AM driver circuit to recognize the required data. The signal transmission method described above is merely an exemplary explanation, and the present invention is not limited to it.

The inter-array data output pin Dout of the first package P1 can be connected to the inter-array data input pin Din of the second package P2 in the same stage through the inter-array data line D, and the inter-array data output pin Dout of the second package P2 is connected to the next second package P2 in the same stage through the inter-array data line D and so on. The inter-array data line D includes the connection between the inter-array data input pin Din and inter-array data output Dout of each second package P2. That is, the AM light emitting circuits are serially connected to each other through the inter-array data line. In terms of the signal transmission operation, the AM driver circuit of the first package P1 can generate an inter-array data signal according to the required data obtained from the serial data packet and output the inter-array data signal through the inter-array data output pin Dout. Then, the AM driver circuit of the first package P1 can transmit the inter-array data signal to the inter-array data input pin Din of the second package P2 through the inter-array data line D. The AM light emitting circuit of the second package P2 can generate a control signal for light emitting elements (e.g. one or more of red, green, blue, and white light emitting diodes) and transmit the inter-array data signal to the inter-array data input pin Din of the next second package P2 through the data output pin Dout for the next second package P2 to generate a control signal for the light emitting element, and so on. That is to say, the AM driver circuit can use a series control method to control the AM light emitting circuits.

The current output pin Iout can be connected to the current input pin Iin of each second package P2 in the same stage through the current supply line I for providing the base current related to the driving of the light emitting element in the AM light emitting circuit. In another embodiment, the first package P1 has ten pins. In addition to the aforementioned eight pins, the first package P1 further has another two current output pins. That is, the first package P1 has three current output pins in total. The three current output pins can output the base currents related to the driving of the three light emitting elements respectively. The second package P2 has eight pins. In addition to the aforementioned six pins, the second package P2 has another two current input pins. That is, the second package P2 has three current input pins in total. The three current input pins can receive the base currents related to the driving of the three light emitting elements from the first package P1 respectively. For example, the aforementioned three light emitting elements can be red, green, or blue light emitting diodes.

The light emitting device 1 can be an RGB LED full-color display screen or a monochrome LCD backlight module. Each of the first package P1 and the second package P2 can be regarded as a pixel or light source unit. With the above-mentioned package structure, a driver circuit and a light emitting circuit may be disposed on the same substrate in the light emitting device 1. Therefore, compared with the existing display screen or backlight module, there may be no need to dispose an additional driver circuit board in the light emitting device 1, which may reduce installation space or increase the number of light source modules that can be installed in a space unit. Additionally, compared with the existing display screen or backlight module, the light emitting device 1 having the above-mentioned method of driver circuit series controlling the light emitting circuit may have a smaller number of driving circuits with lower complexity, so in addition to saving installation space, it may also have a lower installation cost.

Figure 2:
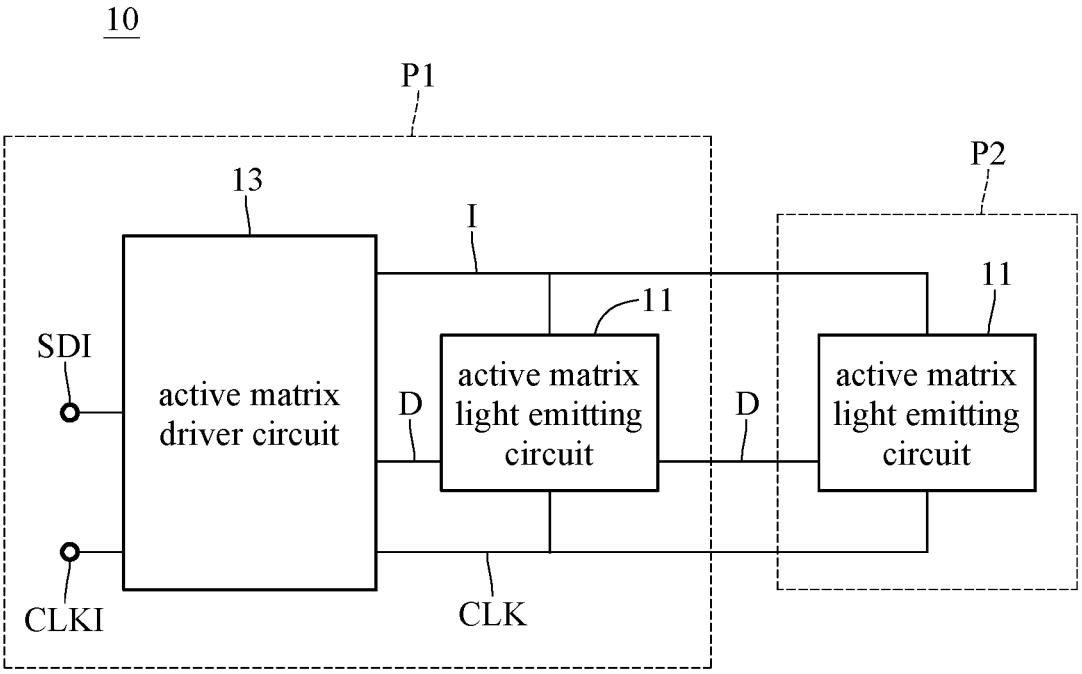
FIG. 2 is a functional block diagram of a light emitting assembly according to an embodiment of the present disclosure.

Next, please refer to FIG. 2 for the illustration of the composition of the light emitting assembly 10. FIG. 2 is a functional block diagram of a light emitting assembly according to an embodiment of the present disclosure. As shown in FIG. 2, The light emitting assembly 10 can comprise multiple AM light emitting circuits 11 and an AM driver circuits 13, wherein the AM light emitting circuits 11 are connected to the clock line CLK and the current supply line I, and serially connected to each other through the inter-array data line D, and the AM driver circuit 13 is connected to the AM light emitting circuits 11 through the inter-array data line D, the clock line CLK and the current supply line I. As mentioned before, the AM driver circuit 13 and one of the AM light emitting circuits 11 can be disposed in the first package P1. The remaining AM light emitting circuit 11 can be installed in the second packages P2. In another embodiment, the first package P1 can only comprise AM driver circuit 13. The AM light emitting circuits 11 are respectively installed in the second packages P2.

The AM light emitting circuit 11 can control whether to emit light and brightness according to the clock signal, data signal and current provided by the AM driver circuit 13. More particularly, AM driver circuit 13 can receive a clock signal through the clock input pin CLKI, and send the clock signal to each AM light emitting circuit 11 through the clock line CLK, receive a serial data packet through the serial data input pin SDI, generate a data signal accordingly and send the data signal to AM light emitting circuit 11 through the inter-array data line D; generate a base current and provide the base current to each AM light emitting circuit 11 through the current supply line I. Each AM light emitting circuit 11 can control the on/off state and brightness of at least one light emitting element (such as a light emitting diode) based on the clock signal from the clock line CLK, the data signal from inter-array data line D and the base current from current supply line I, wherein the components of AM light emitting circuit 11 and the AM driver circuit 13 are described later.

It should be noted that FIG. 2 only exemplarily shows the pins of the AM light emitting circuit 11 and the AM driver circuit 13. In addition to the pins shown in FIG. 2, the AM driver circuit 13 can also comprise other pins of the first package P1 shown in FIG. 1B. Besides, the AM light emitting circuit 11 can also comprise other pins of the second package P2 shown in FIG. 1B.

The present disclosure proposes multiple embodiments of the light emitting assembly with AM light emitting circuits with different element compositions. The embodiments are explained one by one as follows. Please refer to FIG. 2 and FIG. 3A-FIG. 3C, wherein FIG. 3A and FIG. 3B are functional block diagrams of an AM light emitting circuit according to the first and second embodiments of the present disclosure, and FIG. 3C is a schematic diagram of the timing and control logic of an AM light emitting circuit according to the first and second embodiments of the present disclosure.

Figure 3A:
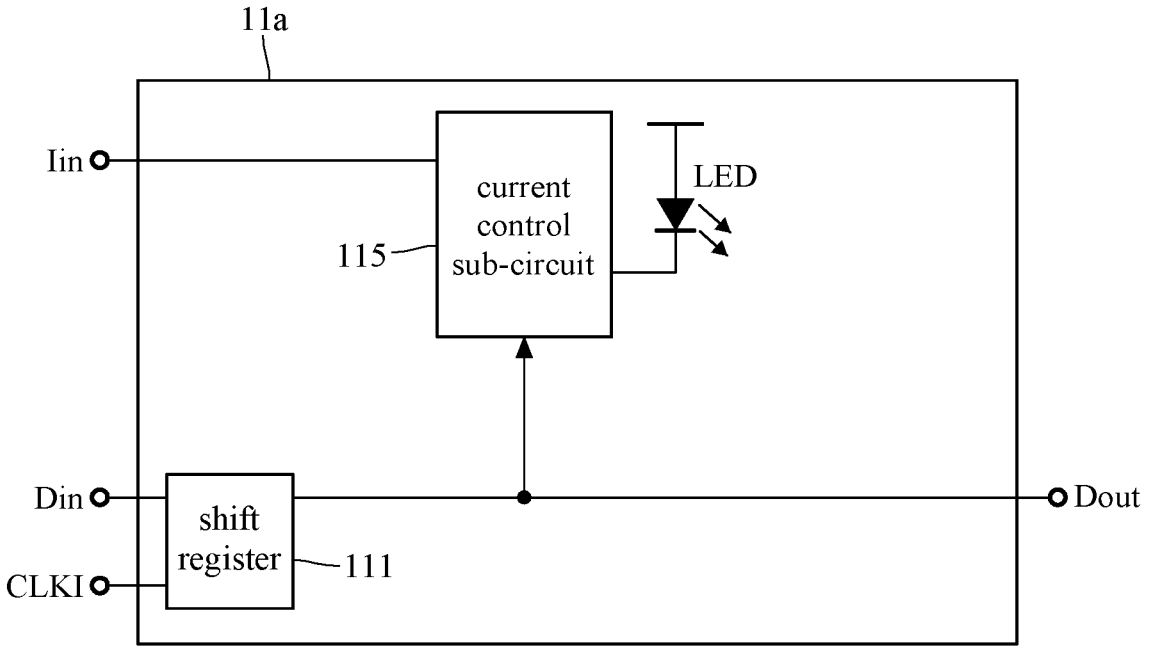
FIG. 3A is a functional block diagram of an AM light emitting circuit according to the first embodiment of the present disclosure.

In the first embodiment shown in FIG. 3A, the AM light emitting circuit 11*a* comprises a light emitting element LED, a shift register 111 and a current control sub-circuit 115 and has the clock signal input pin CLKI, the inter-array data input pin Din, the inter-array data output pin, and the current input pin Iin. The two input terminals of the shift register 111 are respectively connected to the inter-array data input pin Din and the clock signal input pin CLKI. In addition, the output terminal of shift register 111 is connected to the inter-array data output pin Dout and the current control sub-circuit 115. The shift register 111 comprises a flip-flop which is configured to generate a control signal based on the clock signal from the clock line CLK and the data signal from the inter-array data line D, transmit the control signal to the current control sub-circuit 115, and transmit the control signal to the next AM light emitting circuit through the data output pin Dout. (if there is no next AM light emitting circuit, the shift register 111 doesn't output the control signal through data output pin Dout).

The current control sub-circuit 115 is connected to the current input pin Iin, the shift register 111, and the light emitting element LED. Additionally, the current control sub-circuit 115 is configured to control the brightness of the light emitting element LED based on the base current from the current supply line I and the control signal from the shift register 111. More particularly, the current control sub-circuit 115 may drive the light emitting element LED using a source current or a sink current, and can use one or both of pulse-width modulation (PWM) and pulse-amplitude modulation (PAM; or called pulse-level modulation, PLM) to control the brightness of the light emitting element LED. The current control sub-circuit 115 can comprise a switch element group, a current mirror, and a capacitor. The switch element group selectively provides the base current at the current input pin Iin to the current mirror and capacitor according to the control signal, wherein the control logic is further described later. The current mirror is configured to generate and output an output current proportional to the base current to control the brightness of the light emitting element LED. When the switch element group is turned off, the capacitor maintains the same voltage as the voltage before the switch element group is turned off.

Figure 3B:
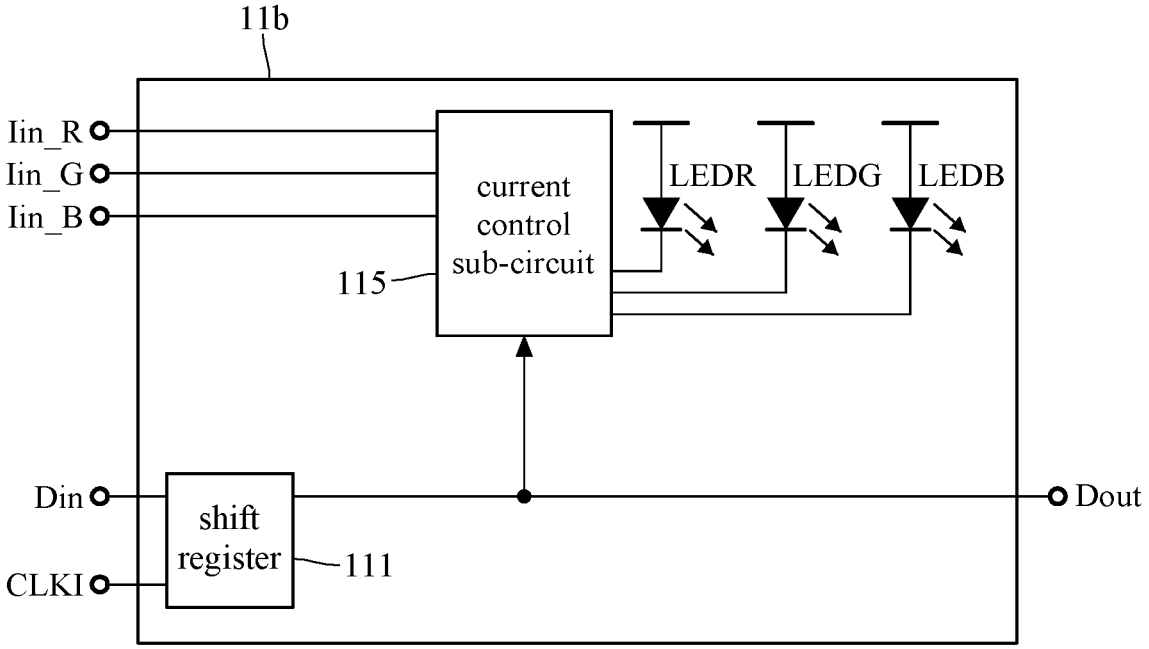
FIG. 3B is a functional block diagram of an AM light emitting circuit according to the second embodiment of the present disclosure.
Figure 3C:
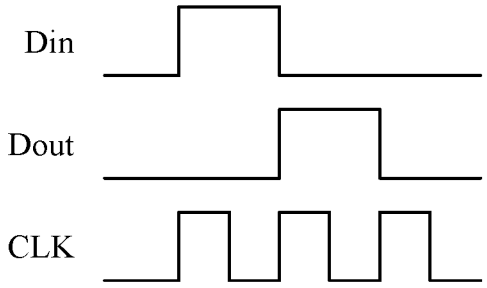
FIG. 3C is a schematic diagram of the timing and control logic of an AM light emitting circuit according to the first and second embodiments of the present disclosure.

In the first embodiment shown in FIG. 3B, the AM light emitting circuit 11*b* comprises a plurality of the light emitting elements LEDR, LEDG, LEDB, the shift register 111, and the current control sub-circuit 115. The connections, functions and operations of the shift register 111 shown in FIG. 3B are the same as those in the embodiment shown in FIG. 3A, so they are not repeated. The difference between the two embodiments is that the number of the light emitting elements LEDR, LEDG and LEDB is more than one and there are multiple current input pins Iin_R, Iin_G and Iin_B in the embodiment shown in FIG. 3B. The current input pins Iin_R, Iin_G and Iin_B are all connected to the current control sub-circuit 115 to provide the base currents respectively corresponding to the light emitting elements LEDR, LEDG and LEDB to the current control sub-circuit 115, wherein the light emitting element LEDR, LEDG and LEDB can be red, green and blue light emitting diodes respectively. In the embodiment shown in FIG. 3B, the current control sub-circuit 115 can comprise a plurality of control components controlling light emitting element LEDR, LEDG and LEDB respectively. In other words, the number of control components can be the same as the number of the light emitting elements to control the light emitting elements LEDR, LEDG and LEDB in a one-to-one manner. The way each control component drives and controls the corresponding light emitting element and the elements included in the control component are as the same as the way the current control sub-circuit 115 drives and controls the light emitting element LED and the elements included in the current control sub-circuit 115 described in the embodiment of FIG. 3A, so they are not repeated.

In the first and second embodiments shown in FIG. 3A and FIG. 3B, the number of the shift register 111 is one and the control logic for the light emitting element LED performed by the current control sub-circuit 115 based on the control signal from the shift register 111 is shown in FIG. 3C: when the output value of the shift register 111 (the value of the inter-array data output pin Dout) is 0, the control signal indicates that no action is performed on the light emitting element LED/light emitting elements LEDR, LEDG and LEDB; when the output value is 1, the control signal indicates to perform a write operation or erase operation on the light emitting element LED/light emitting elements LEDR, LEDG and LEDB. More particularly, when the output value corresponding to the control signal received by the current control sub-circuit 115/control component is 1, and the base current received by the current control sub-circuit 115/control component is greater than 0 (e.g. 1 mA), the current control sub-circuit 115/control component performs the write operation on the light emitting element LED/light emitting elements LEDR, LEDG and LEDB; when the output value corresponding to the control signal is 1 and the base current is 0, the current control sub-circuit 115/control component performs the erase operation on the light emitting element LED/light emitting elements LEDR, LEDG and LEDB. It should be noted here that the above-mentioned control logic is only an example, and the control logic can also be the opposite of the above-mentioned logic or other logic designed according to requirements, which is not limited in the present disclosure.

Figure 4A:
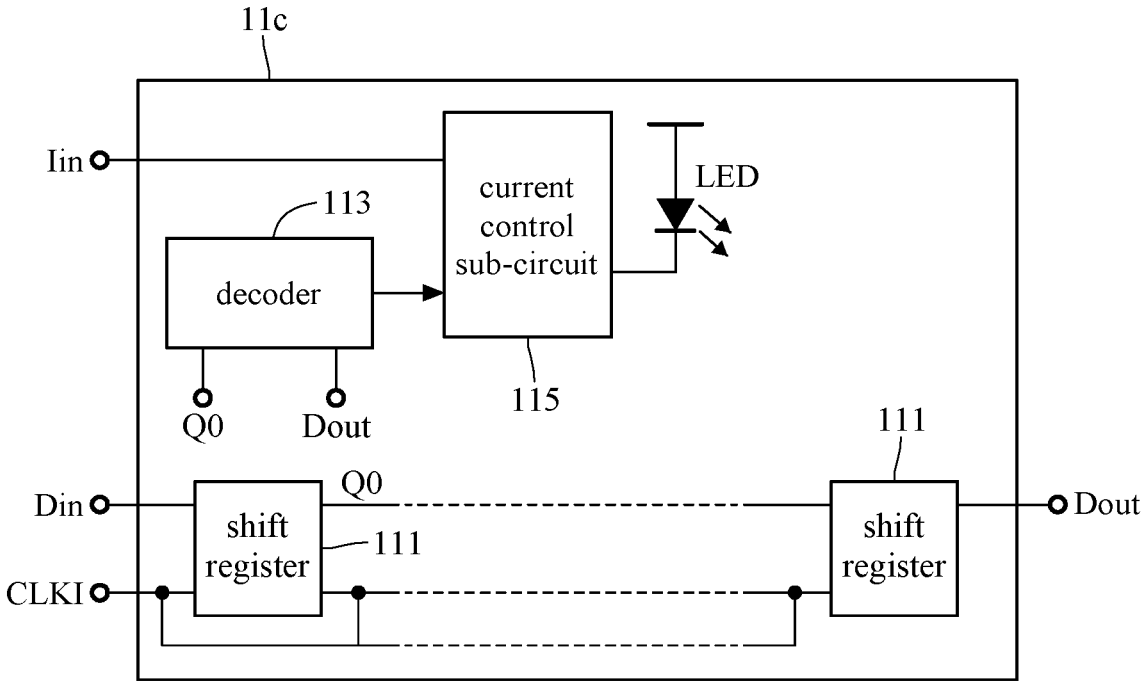
FIG. 4A is a functional block diagram of an AM light emitting circuit according to the third embodiment of the present disclosure.
Figure 4B:
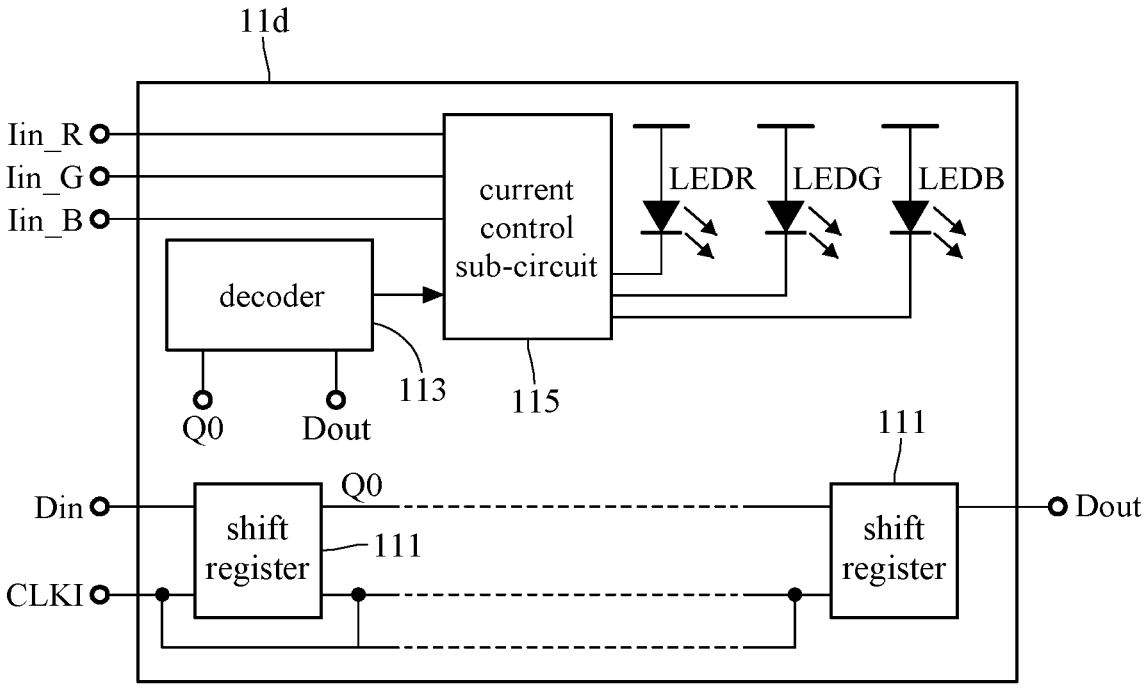
FIG. 4B is a functional block diagram of an AM light emitting circuit according to the fourth embodiment of the present disclosure.
Figure 4C:
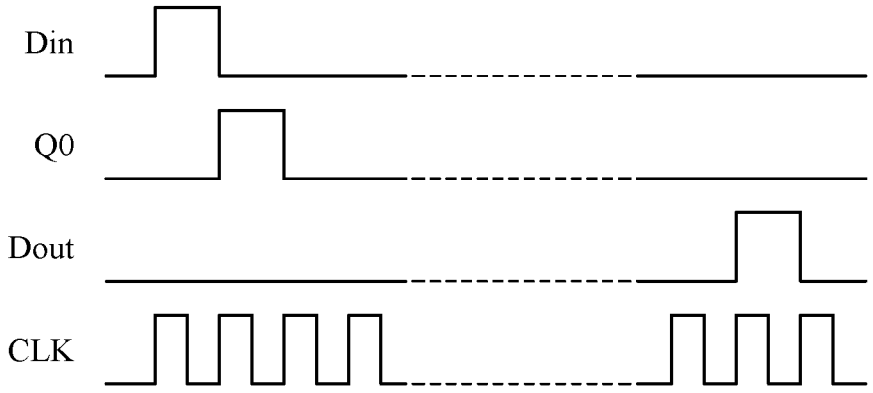
FIG. 4C is a schematic diagram of the timing and control logic of an AM light emitting circuit according to the third and fourth embodiments of the present disclosure.

Please refer to FIG. 2 and FIG. 4A-FIG. 4C, wherein FIG. 4A and FIG. 4B are functional block diagrams of an AM light emitting circuit according to the third and fourth embodiments of the present disclosure. FIG. 4C is a schematic diagram of the timing and control logic of an AM light emitting circuit according to the third and fourth embodiments of the present disclosure.

In the third embodiment as shown in FIG. 4A, the AM light emitting circuit 11*c* comprises a light emitting element LED, a plurality of shift registers 111, a decoder 113, and a current control sub-circuit 115, and has the clock signal input pin CLKI, the inter-array data input pin Din, the inter-array data output pin Dout, and the current input pin Iin. The plurality of shift registers 111 are connected to each other in a series, and the two input terminals of the first shift register 111 in the series are respectively connected to the inter-array data input pin Din and the clock signal input pin CLKI. In addition, the data output terminal of the shift register 111 (with value Q0) is connected to the second shift register 111. For the second shift register 111, its two input terminals are respectively connected to the data output terminal of the first shift register 111 and the clock line CLK, and the data output terminal of the second shift register 111 is connected to the next shift register 111. If there are more than three shift registers the remaining shift register(s) 111 except the last shift register 111 also has the same connections as described above. The data output terminal of the last shift register 111 is connected to the inter-array data output pin Dout.

The decoder 113 may have two input terminals respectively connected to the data output terminal of the first shift register 111 (with the value Q0) and the data output terminal of the last shift register 111 (with the same value as the inter-array data output pin Dout), and the output terminal of the decoder 113 is connected to the current control sub-circuit 115. The decoder 113 is configured to generate an enabling signal according to the value obtained by each input terminal (i.e. the control signal composed of the output value of each shift register 111), and transmit the enabling signal to the current control sub-circuit 115. The control logic is further described later.

The current control sub-circuit 115 is connected to the current input pin Iin, the decoder 113, and the light emitting element LED and is configured to control the brightness of the light emitting element LED based on the base current from the current supply line I and the enabling signal from the decoder 113. More particularly, the current control sub-circuit 115 may drive the light emitting element LED using a source current or a sink current, and can use one or both of pulse-width modulation (PWM) and pulse-amplitude modulation (PAM; or called pulse-level modulation, PLM) to control the brightness of the light emitting element LED. The current control sub-circuit 115 can comprise a switch element group, a current mirror, and a capacitor, wherein the switch element group selectively provides the base current at the current input pin Iin to the current mirror and capacitor according to the enabling signal. the current mirror is configured to generate and output an output current proportional to the base current to control the brightness of the light emitting element LED, and when the switch element group is turned off, the capacitor maintains the same voltage as the voltage before the switch element group is turned off.

In the fourth embodiment as shown in FIG. 4B, the AM light emitting circuit 11*d* comprises a plurality of the light emitting elements LEDR, LEDG, LEDB, a plurality of shift registers 111, the decoder 113, and the current control sub-circuit 115. The connections, functions and operations of the shift registers 111 and the decoder 113 shown in FIG. 4B are the same as those in the embodiments shown in FIG. 4A, so they are not repeated. The difference between the two embodiments is that the number of the light emitting elements LEDR, LEDG and LEDB is more than one and there are multiple current input pins Iin_R, Iin_G and Iin_B in the embodiment shown in FIG. 4B. The current input pins Iin_R, Iin_G and Iin_B are all connected to the current control sub-circuit 115 to provide the base currents respectively corresponding to the light emitting element LEDR, LEDG and LEDB to the current control sub-circuit 115, wherein the light emitting element LEDR, LEDG and LEDB can be red, green and blue light emitting diodes respectively. In the embodiment shown in FIG. 4B, the current control sub-circuit 115 can comprise a plurality of control components which control the light emitting element LEDR, LEDG and LEDB, wherein the way each control component drives and controls the corresponding light emitting element and the elements included in the control component are the same as the way the current control sub-circuit 115 drives and controls the light emitting element LED and the elements included in the control component described in the embodiment of FIG. 4A, so they are not described here repeatedly.

In the third and fourth embodiments as shown in FIG. 4A and FIG. 4B, the number of shift register 111 is greater than one (two or more), and the control logic of decoder 113 is shown in FIG. 4C: when the output value (Q0) of the first shift register 111 is 0 and the output value of the last shift register 111 (the value of inter-array data output pin Dout, hereinafter represented by Dout) is 0, the enabling signal indicates that no action is performed on the light emitting element LED/light emitting elements LEDR, LEDG and LEDB; when Q0 is 1 and Dout is 0, the enabling signal indicates to perform a write operation or erase operation on the light emitting element LED/light emitting elements LEDR, LEDG and LEDB; when Q0 is 0 and Dout is 1, the enabling signal indicates to perform a write operation or erase operation the light emitting element LED/light emitting elements LEDR, LEDG and LEDB. More particularly, when one of Q0 and Dout is 1 and the other is 0, and the base current received by the current control sub-circuit 115/control component is greater than 0 (e.g. 1 mA), the current control sub-circuit 115 performs the write operation on the light emitting element LED/light emitting elements LEDR, LEDG and LEDB; when one of Q0 and Dout is 1 and the other is 0, and the base current received by the current control sub-circuit 115/control component is 0, the current control sub-circuit 115/control component performs the erase operation on light emitting element LED/light emitting elements LEDR, LEDG and LEDB. It should be noted here that the above-mentioned control logic is only an example, and the control logic can also be the opposite of the above-mentioned logic or other logic designed on demand, which is not limited in the present disclosure.

Figure 5A:
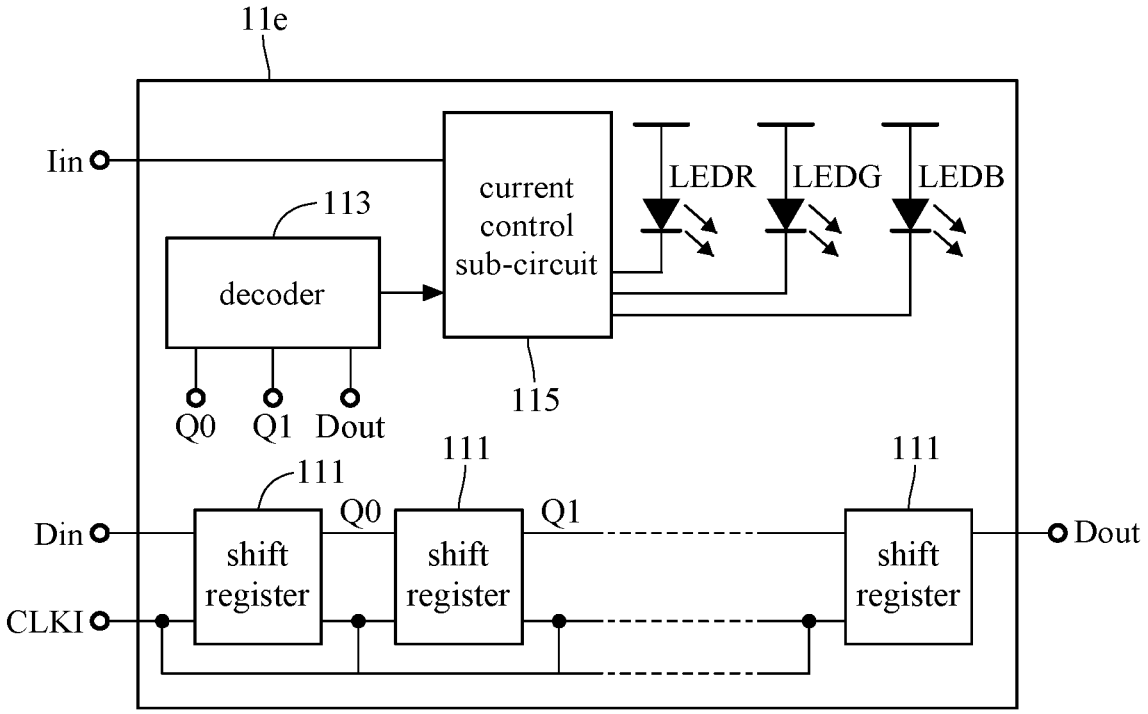
FIG. 5A is a functional block diagram of an AM light emitting circuit according to the fifth embodiment of the present disclosure.
Figure 5B:
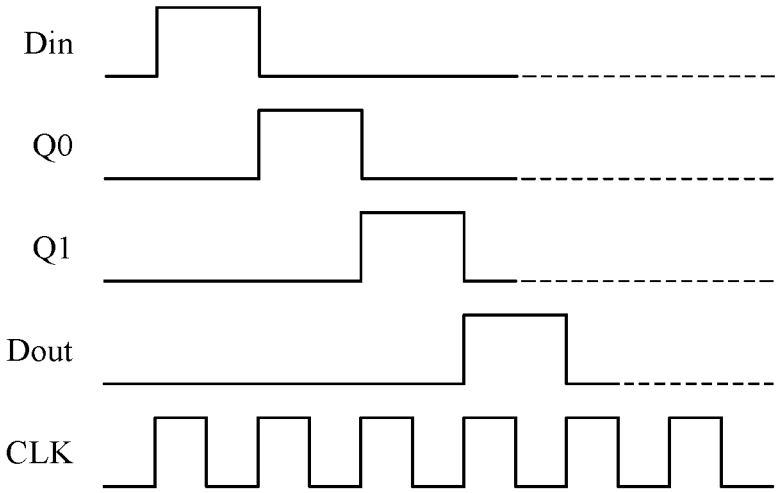
FIG. 5B is a schematic diagram of the timing and control logic of an AM light emitting circuit according to fifth embodiment of the present disclosure.

Please refer to FIG. 2, FIG. 5A, and FIG. 5B, wherein FIG. 5A is a functional block diagram of an AM light emitting circuit according to the fifth embodiment of the present disclosure. FIG. 5B is a schematic diagram of the timing and control logic of an AM light emitting circuit according to the fifth embodiment of the present disclosure.

In the fifth embodiment as shown in FIG. 5A, the AM light emitting circuit 11*e* comprises a plurality of light emitting elements LEDR, LEDG, LEDB, a plurality of shift registers 111, a decoder 113 and a current control sub-circuit 115 and has the clock signal input pin CLKI, the inter-array data input pin Din, the inter-array data output pin Dout and the current input pin Iin. The light emitting elements LEDR, LEDG and LEDB can be red, green and blue light emitting diodes respectively. The registers 111 are connected to each other in a series. The two input terminals of the first shift register 111 in the series are respectively connected to the inter-array data input pin Din and the clock signal input pin CLKJ. Besides, the data output terminal of the shift register 111 (with value Q0) is connected to the second shift register 111. For the second shift register 111, its two input terminals are respectively connected to the data output terminal and clock line CLK of the first shift register 111, and the data output terminal of the second shift register 111 (with the value Q1) is connected to the next shift register 111 If there are more than three shift registers the remaining shift register(s) 111 except the last shift register 111 also has the same connections as described above. The data output terminal of the last shift register 111 is connected to the inter-array data output pin Dout.

The decoder 113 can have three input terminals respectively connected to the data output terminal of the first shift register 111 (with the value Q0), the data output terminal of the second shift register (with the value Q1), and the data output terminal of the last shift register 111 (with the same value as inter-array data output pin Dout), and the output of decoder 113 is connected to current control sub-circuit 115. The decoder 113 is configured to generate an enabling signal according to the value obtained by each input terminal (i.e. the control signal composed of the output value of each shift register 111), and transmit the enabling signal to the current control sub-circuit 115. The control logic further is described later.

The current control sub-circuit 115 is connected to the current input pins Iin, the decoder 113 and the light emitting elements LEDR, LEDG and LEDB, and is configured to control the brightness of the light emitting elements LEDR, LEDG and LEDB according to the base current from the current supply line I and the enabling signal from decoder 113. More particularly, the current control sub-circuit 115 may drive the light emitting elements LEDR, LEDG or LEDB using a source current or a sink current, and can use one or both of the pulse-width modulation PWM) and pulse-amplitude modulation (PAM; or called pulse-level modulation, PLM) to control the brightness of light emitting element LEDR, LEDG or LEDB. The current control sub-circuit 115 can comprise multiple control components to control the light emitting elements LEDR, LEDG and LEDB respectively. In the other words, the number of control components may be the same as the number of light emitting elements to control the light emitting elements LEDR, LEDG and LEDB in a one-to-one manner. Each control component is connected to the current input pin Iin to receive the base current and connected to the decoder 113 to receive the decoded control signal. Each control component comprises a switch element group, a current mirror and a capacitor, wherein the switch element group selectively provides the base current of the current input pin Iin to the current mirror and capacitor according to the enabling signal, the current mirror is configured to generate and output an output current proportional to the base current to control the brightness of the light emitting element LEDR, LEDG or LEDB, and when the switch element group is turned off, the capacitor maintains the same voltage as the voltage before the switch element group is turned off In particular, the fifth embodiment as shown in FIG. 5A may be a full-color light-emitting circuit implemented with 6 pins. The full-color light-emitting circuit only has one current input pin Iin, and has at least three shift registers 111. The full-color light-emitting circuit combines the output values of more than three shift registers 111 to make the control signal corresponding to the light emitting element LEDR, LEDG and LEDB respectively. FIG. 5B exemplarily shows the logic of the decoder 113 producing the enabling signal: when the output value (Q0) of the first shift register 111 is 0, the output value (Q1) of the second shift register 111 is 0, and the output value of the last shift register 111 (the value of the inter-array data output pin Dout, represented by Dout hereinafter) is 0, the enabling signal indicates that no action is performed on the light emitting elements LEDR, LEDG and LEDB; when Q0 is 1 and Q1 and Dout are 0, the enabling signal indicates to perform a write operation or erase operation on the light emitting element LEDR; when Q1 is 1 and Q0 and Dout are 0, the enabling signal indicates to perform a write operation or erase operation on the light emitting element LEDG; when Dout is 1 and Q0 and Q1 are zero, the enabling signal indicates to perform a write operation or erase operation on the light emitting element LEDB. More particularly, the control component performs a write operation or erase operation on the corresponding light emitting element LEDR, LEDG, or LEDB based on the size of the base current. For example, when the base current is greater than 0 (e.g., 1 mA), the control component performs the write operation on the light emitting element LEDR, LEDG, or LEDB; when base current is 0, the control component performs the erase operation on the light emitting element LEDR, LEDG or LEDB. It should be noted here that the above-mentioned control logic is only an example, and the control logic can also be the opposite of the above-mentioned logic or other logic designed according to requirements, which is not limited in the present disclosure.

Figure 6A:
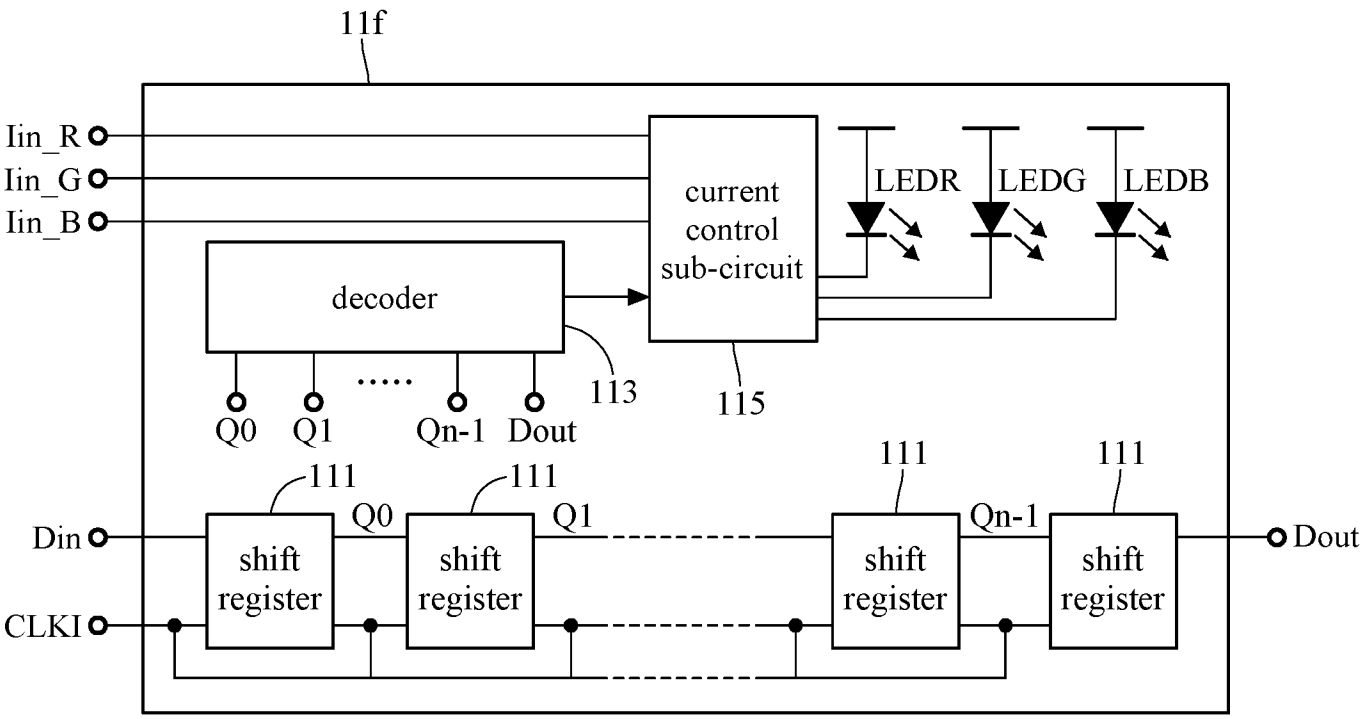
FIG. 6A is a functional block diagram of an AM light emitting circuit according to the sixth embodiment of the present disclosure.
Figure 6B:
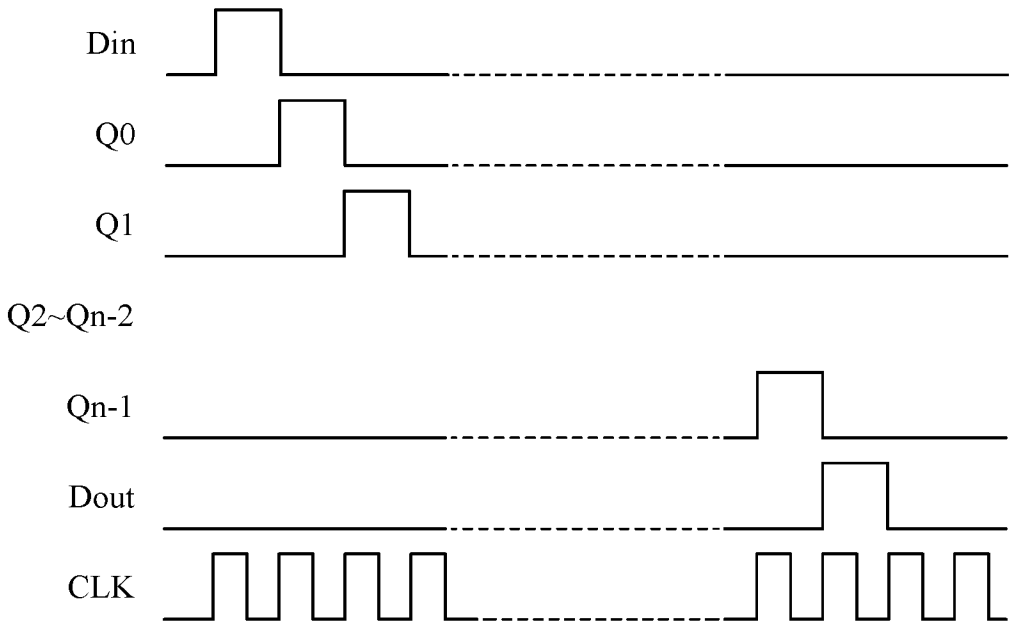
FIG. 6B is a schematic diagram of the timing and control logic of an AM light emitting circuit according to the sixth embodiment of the present disclosure.

Please refer to FIG. 2, FIG. 6A and FIG. 6B, wherein FIG. 6A is a functional block diagram of an AM light emitting circuit according to the sixth embodiment of the present disclosure. FIG. 6B is a schematic diagram of the timing and control logic of an AM light emitting circuit according to the sixth embodiment of the present disclosure.

In the sixth embodiment as shown in FIG. 6A, the AM light emitting circuit 1 if comprises the light emitting element LED, N shift registers 111 (N is an integer and greater than one), the decoder 113 and the current control sub-circuit 115 and has the clock signal input pin CLKI, the inter-array data input pin Din, the inter-array data output pin Dout and three current input pins Iin_R, Iin_G and Iin_B. The N shift registers 111 are connected to each other in a series. The two input terminals of the first shift register 111 in the series are respectively connected to the inter-array data input pin Din and the clock signal input pin CLKI. In addition, the data output terminal of shift register 111 (with the value Q0) is connected to the first shift register 111. For the second shift register 111, its two input terminals are respectively connected to the data output terminal and the clock line CLK of the first shift register 111, and the data output terminal of the second shift register 111 is then connected to the next shift register 111. If there are more than three shift registers the remaining shift register(s) 111 except the last shift register 111 also has the same connections as described above. The two input terminals of the last ($N^{th}$) shift register 111 are respectively connected to the data output terminal (with the value Qn−1) and the clock line CLK of the second to the last ($N-1^{th}$) shift register 111, and the data output terminal of the Nth shift register 111 is connected to the inter-array data output pin Dout.

The decoder 113 may have N input terminals respectively connected to the data output terminals of the N shift registers 111 mentioned above to generate the enabling signal according to the value obtained by each input terminal (i.e. the control signal formed by the output values of the shift registers 111), and the output terminal of the decoder 113 is connected to the current control sub-circuit 115 to transmit the enabling signal to the current control sub-circuit 115. The control logic further is described later.

The current control sub-circuit 115 is connected to the current input pin Iin_R, Iin_G, Iin_B, the decoder 113 and the light emitting elements LED_R, LED_G and LED_B and is configured to control the brightness of the light emitting elements LED_R, LED_G and LED_B based on base currents from the current input pins Iin_R, Iin_G and Iin_B and the enabling signal from the decoder 113. More particularly, the current control sub-circuit 115 may drive the light emitting element LED using a source current or a sink current and use one or both of pulse-width modulation (Pulse-width modulation, PWM) and pulse-amplitude modulation (PAM; or called pulse-level modulation, PLM) to control the brightness of the light emitting element LED. The current control sub-circuit 115 can comprise a plurality of control components to control the light emitting elements LEDR, LEDG and LEDB respectively. That is to say, the number of the control components may be the same as the number of the light emitting elements to control the light emitting elements LEDR, LEDG and LEDB one to one. The control components corresponding to the light emitting elements LEDR, LEDG and LEDB can be connected to the current input pins Iin_R, Iin_G and Iin_B respectively to receive the base current, and they are all connected to the decoder 113 to receive the enabling signal. Each control component comprises the switch element group, the current mirror and the capacitor, wherein the switch element group selectively provides the base current of the current input pins Iin_R, Iin_G or Iin_B to the current mirror and the capacitor according to the enabling signal, the current mirror is configured to generate and output an output current proportional to the base current to control the brightness of the light emitting elements LEDR, LEDG or LEDB, and when the switch element group is turned off, the capacitor maintains the same voltage as the voltage before the switch element group is turned off.

FIG. 6B is exemplarily shown the control logic of the decoder 113 in the sixth embodiment above: when the output value of the first shift register 111 (Q0), the output value of the second shift register 111 (Q1), the output value of the third shift register 111 (Q2), the output value of the N−2th shift register 111 (Qn−2), the output value of the N−1th shift register 111 (Qn−1) and the output value of the Nth shift register 111 (the value of inter-array data output pin Dout, hereinafter represented by Dout) are 0, the enabling signal indicates that no action is performed on the light emitting elements LEDR, LEDG and LEDB; when Q0 is 1 and Q1, Q2, Qn−2, Qn−1 and Dout are 0, the enabling signal indicates to perform a write operation or erase operation on light emitting element LEDR; when Q1 is 1 and Q0, Q2, Qn−2, Qn−1 and Dout are 0, the enabling signal indicates to perform a write operation or erase operation on the light emitting element LEDG; when Q2 is 1 and Q0, Q1, Qn−2, Qn−1 and Dout are 0, the enabling signal indicates to perform a write operation or erase operation on the light emitting element LEDB; when Qn−2 is 1 and Q0, Q1, Q2, Qn−1 and Dout are 0, the enabling signal indicates to perform a write operation or erase operation on the light emitting element LEDR; when Qn−1 is 1 and Q0, Q1, Q2, Qn−2 and Dout are 0, the enabling signal indicates to perform a write operation or erase operation on the light emitting element LEDG; when Dout is 1 and Q0, Q1, Q2, Qn−2 and Qn−1 are 0, the enabling signal indicates to perform a write operation or erase operation on the light emitting element LEDB. More particularly, the control component performs a write operation or erase operation on the corresponding light emitting element LEDR, LEDG, or LEDB based on the size of the base current. For example, when the base current is greater than 0 (e.g., 1 mA), the control component performs the write operation on the light emitting element LEDR, LEDG, or LEDB; when the base current is 0, the control component performs the erase operation on the light emitting element LEDR, LEDG or LEDB. It should be noted here that the above-mentioned control logic is only an example, and the control logic can also be the opposite of the above-mentioned logic or other logic designed according to requirements, which is not limited in the present disclosure.

Figure 7A:
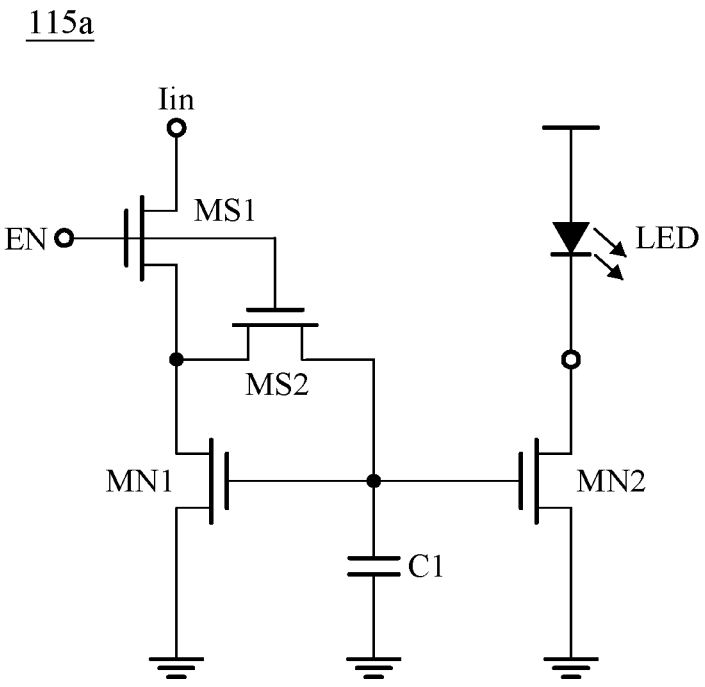
FIG. 7A is a functional block diagram of a current control sub-circuit in an AM light emitting circuit according to an embodiment of the present disclosure.
Figure 7B:
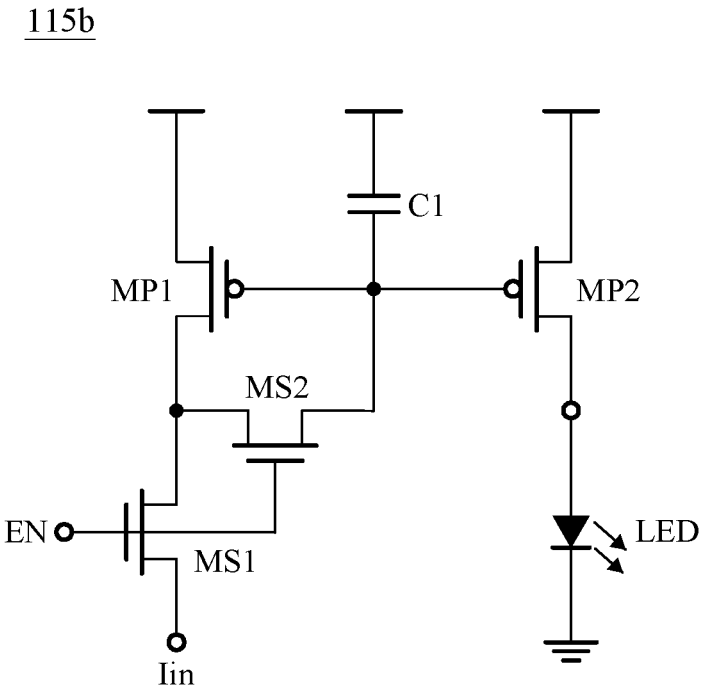
FIG. 7B is a functional block diagram of a current control sub-circuit in an AM light emitting circuit according to another embodiment of the present disclosure.

The circuit composition of the current control sub-circuit 115 in the embodiments mentioned before is further described as below. Please refer to FIG. 7A and FIG. 7B, wherein FIG. 7A and FIG. 7B show the implementations of two current control sub-circuits 115*a* and 115*b* respectively. As mentioned before, the current control sub-circuit 115*a*/115*b* can comprise a current mirror, a switch element group and a capacitor. In FIG. 7A, the current control sub-circuit 115*a* drives the light emitting element LED using a sink current. The current control sub-circuit 115*a* comprises the current mirror composed of transistors MN1 and MN2, the switch element group composed of transistors MS1 and MS2 and the capacitor C1, wherein the drain terminal of the transistor MS1 is connected to the current input pin Iin, and the control terminal EN (gate terminal) of the transistor MS1 is connected to the output terminal of the single shift register to receive the control signal, or connected to the output terminal of the decoder to receive the enabling signal. In FIG. 7B, the current control sub-circuit 115*b* drives the light emitting element LED using a source current. the current control sub-circuit 115*b* comprises the current mirror composed of transistors MP1 and MP2, the switch element group composed of transistors MS1 and MS2 and the capacitor C1, wherein the source terminal of the transistor MS1 is connected to the current input pin Iin, and the control terminal EN (gate terminal) of the transistor MS1 is connected to the output terminal of the single shift register to receive the control signal, or connected to the output terminal of the decoder to receive the enabling signal. It should be noted here that the above-mentioned current control sub-circuit 115*a*/115*b* is only an example. The current control sub-circuit 115 may be implemented by a circuit with capacitors, which is not limited in the present disclosure.

In particular, in the embodiment where the number of the light emitting elements LEDR, LEDG and LEDB is more than one, multiple control components of current control sub-circuits 115 can each be implemented with the circuit in FIG. 7A or FIG. 7B. More particularly, in the embodiment where the number of the light emitting elements LEDR, LEDG and LEDB is more than one and the number of the current input pins Iin_R, Iin_G and Iin_B are also more than one, the drain terminal of the transistor MS1 in the control component corresponding to the light emitting element LEDR is connected to the current input pin Iin_R, the drain terminal of the transistor MS1 in the control component corresponding to the light emitting element LEDG is connected to the current input pin Iin_G, and the drain terminal of the transistor MS1 in the control component corresponding to the light emitting element LEDB is connected to the current input pin Iin_B. In the embodiment where the number of the light emitting elements LEDR, LEDG and LEDB is more than one and the number of the current input pin Iin is one, the drain terminal of the transistor MS1 in each control component is connected to the current input pin Iin.

Figure 8:
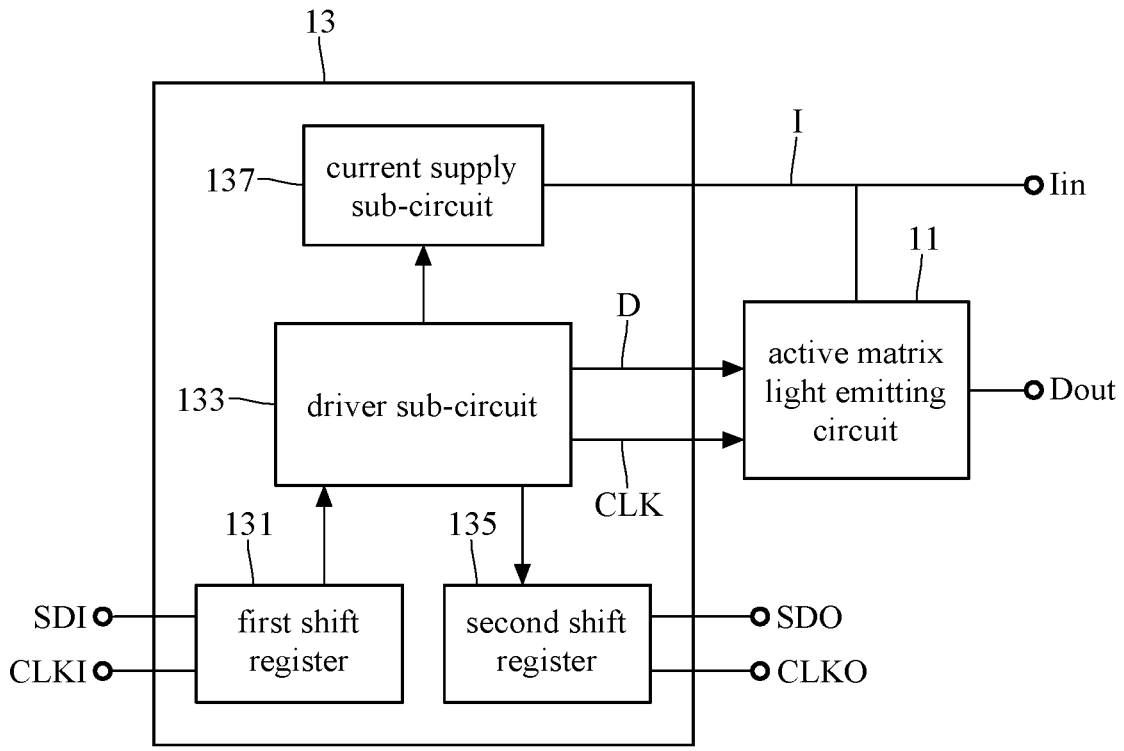
FIG. 8 is a functional block diagram of an AM driver circuit according to an embodiment of the present disclosure.

The composition of the AM driver in the light emitting assembly is further described as below. Please refer to FIG. 2 and FIG. 8, wherein FIG. 8 is a functional block diagram of an AM driver circuit according to an embodiment of the present disclosure. As shown in FIG. 8, the AM driver circuit 13 can comprise a first shift register 131, a driver sub-circuit 133, a second shift register 135 and a current supply sub-circuit 137.

The first shift register group 131 may be an N-bit shift register and is connected to the serial data input pin SDI, the clock signal input pin CLKI and the driver sub-circuit 133. The driver sub-circuit 133 can comprise a PWM and/or PAM driver and a memory (such as SRAM) and is configured to generate a data signal based on the required data in the serial data packet obtained from the serial data input pin SDI. Then, the driver sub-circuit 133 transmits the data signal and the clock signal to the AM light emitting circuit 11 through the inter-array data line D and the clock line CLK respectively, and transmits the remaining parts of the serial data packet to the second shift register 135. The driver sub-circuit 133 can also generate a basic current control signal and transmit the basic current control signal to the current supply sub-circuit 137, wherein the control signal can be a signal pre-designed by the user and stored in the memory. The second shift register 135 is, for example, an N-bit shift register, which is connected to the driver sub-circuit 133, the serial data output pin SDO, and the clock signal output pin CLKO and is configured to transmit the remaining parts of the serial data packet and the clock signal to the AM driver circuit in the next stage through the serial data output pin SDO and the clock signal output pin CLKO respectively. The current supply sub-circuit 137 can comprise a digital-to-analog converter (DAC) and a constant current generator and is configured to generate one or more base currents based on the control signal from the driver sub-circuit 133 to provide to the AM light emitting circuit through one or more current supply line I. More particularly, the control signal generated by the driver sub-circuit 133 can control the value of each of one or more base currents to be zero or greater than zero (for example, 1 mA).

With the above structure, in the AM driver circuit in the light emitting assembly disclosed in the present disclosure, the light emitting circuits are controlled by a series control method and the driver circuit may be implemented with a small number of circuits with low complexity, so the material cost and wiring cost may be low and the installation space required may be small. Through the design of a driver circuit and a light emitting circuit both disposed in the light emitting assembly, there may be no need to dispose an additional driver circuit board in the light emitting device that comprises multiple light emitting assemblies disclosed in the present disclosure, so the installation space needed for the light emitting device may be small or the number of light emitting assemblies that can be installed in a space unit may be large.

What is claimed is:

1. A light emitting assembly comprising:

a plurality of active matrix (AM) light emitting circuits connected to a clock line and at least one current supply line and serially connected to each other through an inter-array data line, wherein each of the plurality of AM light emitting circuits comprises:

at least one light emitting element;

at least one shift register configured to generate a control signal according to a clock signal from the clock line and a data signal from the inter-array data line; and a current control sub-circuit connected to the at least one shift register and the at least one light emitting element, with the current control sub-circuit configured to control brightness of the at least one light emitting element according to a base current from the at least one current supply line and the control signal; and an active matrix (AM) driver circuit connected to the plurality of AM light emitting circuits through the inter-array data line, the clock line and the at least one current supply line and configured to generate the data signal according to a serial data packet and provide the data signal, the clock signal, and the base current to the plurality of AM light emitting circuits, wherein the AM driver circuit and one of the plurality of AM light emitting circuits are disposed in a first package, and remaining one or more of the plurality of AM light emitting circuits are each disposed in a second package.

2. The light emitting assembly according to claim 1, wherein the current control sub-circuit comprises a switch element group, a current mirror, and a capacitor, wherein the switch element group is configured to selectively provide the base current to the current mirror and the capacitor according to the control signal, and the current mirror is configured to generate and output an output current proportional to the base current to control the brightness of the at least one light emitting element.

3. The light emitting assembly according to claim 1, wherein the current control sub-circuit drives the at least one light emitting element by a source current or a sink current.

4. The light emitting assembly according to claim 1, wherein the current control sub-circuit controls the brightness of the at least one light emitting element by one or both of pulse-width modulation and pulse-amplitude modulation.

5. The light emitting assembly according to claim 1, wherein the at least one shift register is a plurality of shift registers, the plurality of shift registers are connected to each other, the control signal is formed by a plurality of output values of the plurality of shift registers, the light emitting assembly further comprises a decoder, the current control sub-circuit is connected to the plurality of shift registers through the decoder, and the decoder is configured to generate an enabling signal according to the control signal for the current control sub-circuit to control the brightness of the at least one light emitting element according to the base current and the enabling signal.

6. The light emitting assembly according to claim 1, wherein the AM driver circuit comprises a first shift register, a driver sub-circuit, a second shift register, and a current supply sub-circuit, wherein the first shift register is configured to receive the serial data packet, wherein the driver sub-circuit is configured to generate the data signal according to the serial data packet, and provide the data signal to the plurality of AM light emitting circuits, and output the serial data packet through the second shift register, and wherein the current supply sub-circuit is configured to generate and provide the base current to the plurality of AM light emitting circuits.

7. A light emitting device comprising a plurality of light emitting assemblies according to claim 1, wherein the AM driver circuits of the plurality of light emitting assemblies are serially connected to each other through the clock line and a serial data line and each of the AM driver circuits of the plurality of light emitting assemblies obtains the serial data packet from the serial data line.

* * * * *